United States Patent [19]

Ōnishi

[11] 4,378,666

[45] Apr. 5, 1983

[54] PACKING MACHINE WITH BAG-SUPPORTING DEVICE

[75] Inventor: Masami Ōnishi, Tokyo, Japan

[73] Assignee: Taiyo Shokai Co., Ltd., Tokyo, Japan

[21] Appl. No.: 187,062

[22] Filed: Sep. 15, 1980

[30] Foreign Application Priority Data

Sep. 14, 1979 [JP] Japan ..... 54-127650[U]

[51] Int. Cl.[3] ..... B65B 1/06; B65B 7/06; B65B 43/26

[52] U.S. Cl. ..... 53/570; 53/551; 53/373

[58] Field of Search ..... 53/551, 552, 570, 373

[56] References Cited

U.S. PATENT DOCUMENTS

| | | | |
|---|---|---|---|
| 1,353,210 | 9/1920 | Bates | 53/451 |
| 3,261,603 | 7/1966 | Peterson | 225/100 X |
| 3,543,467 | 12/1970 | Leasure | 53/552 X |
| 3,579,957 | 5/1971 | Mills, Jr. | 53/573 |
| 3,956,866 | 5/1976 | Lattur | 53/570 X |

FOREIGN PATENT DOCUMENTS

| | | | |
|---|---|---|---|
| 7511156 | 3/1976 | Netherlands | 53/570 |

*Primary Examiner*—John Sipos

*Attorney, Agent, or Firm*—McGlew and Tuttle

[57] ABSTRACT

This invention provides a packing machine with a supporting device for supporting a foremost single bag section of a strip-like plastics bag material. The machine comprises a pair of intermittently operated pinching rollers for intermittently transferring the bag material and a pair of heat-sealers provided thereunder for heat-sealing the foremost single bag section after goods have been packed therein. The bag-supporting device is provided under one of the heat-sealers and comprises a supporting member for supporting the bottom of the bag section when goods are packed therein, the supporting member being arranged to be swung about a horizontal axis and operatively connected with a reciprocating crank mechanism.

3 Claims, 4 Drawing Figures

PACKING MACHINE WITH BAG-SUPPORTING DEVICE

BACKGROUND OF THE INVENTION

1. Field of the Invention

The present invention relates to improvements in or relating to a packing machine which is capable of intermittently packing desired goods by the use of a strip-like bag material made of a collapsed film tube of a thermoplastic synthetic resin such as vinyl or polyethylene.

The strip-like bag material which is ususally used in packing machines of the type described above is of the structure as illustrated in FIG. 1. The illustrated strip-like bag material F comprises a series of interconnected bag sections B which are formed by heat-sealing the collapsed film tube transversely across the same at regular intervals so as to form their respective bottoms 6 and by heat-cutting one side of the tube transversely across the same so as to form their respective opening portions 3 along and adjacent to the bottoms 3. The strip-like bag material F having a series of interconnected bag sections B is wound into the form of a roll as shown in FIG. 1 and loaded on a roll support 2 of the packing machine 10 as shown in FIG. 2.

However, in case where a packing machine of the type described above is provided with heat-sealing means and heat-cutting means for forming a bag section at the leading end of the collapsed film tube, the tube is used as a bag material as it is instead of the aforementioned ready-made bag material F.

2. Description of the Prior Art

In a conventional packing machine such as shown in FIG. 2, a packing operation with the use of the strip-like bag material F is performed as described below. First, the bag material F is pinched between a pair of intermittently operated pinching rollers 11 after being passed over guide rollers 7 in such a way that its leading end depends from the pinching rollers 11. Then the bag material F is conveyed, by actuating the pinching rollers 11, for a distance corresponding to the length of one single bag so as to locate the opening portion 3 of the foremost bag section B between a pair of heat-sealers **12*a*, 12*b*, then during an inoperative interval of the rollers 11, the foremost bag B is inflated by actuating an air blower 4 so that goods 8 can be smoothly supplied into the foremost bag B through a hopper 5. After the goods have been supplied to the bag, operation of the blower 4 is stopped and the bag is sealed along its opening portion 3 by means of the heat-sealers 12*a*, 12*b* and finally, the goods-charged bag B is separated from the subsequent bag B of the bag material F. Thereafter, such packing operation is repeated by operating the pinching rollers 11**.

During the packing operation by the conventional packing machine, goods are filled into the foremost bag B depending substantially vertically along an upright frame part 13 which also serve as a guide plate for the dependent bag and accordingly, the bag tends to be deformed as a whole, as illustrated in FIGS. 2 and 3, by the weight of the goods therein, especially when the goods are small articles such as parts of machinery, electronics elements, granular articles etc.. Such deformation inevitably causes the opening portion 3 of the bag to be irregularly opened, as shown in FIG. 3, thus causing incorrect or incomplete sealing of the opening portion 3 by the heat-sealers **12*a*, 12*b***.

SUMMARY OF THE INVENTION

The present invention is intended to eliminate the drawbacks and inconveniences indicated with the conventional packing machines and to provide an improved packing machine which is capable of completely and beautifully heat-sealing an opening portion of each bag section formed or to be formed in a strip-like bag material of a collapsed plastics film tube after goods have been charged into the bag.

It is, therefore, one object of the present invention to provide a packing machine of the character described, in which a supporting device for adjustably supporting the bottom of the leading bag section of the bag material is provided which is capable of locating the opening portion of the bag section in a substantially horizontal plane so that the opening portion may be completely and beautifully heat-sealed.

Another object of the invention is to provide a packing machine of the character described which is capable of working regardless of the fact that the bag material as used comprises long bag sections or short bag sections.

Other objects and advantageous features of the present invention will become apparent from the following description taken in conjunction with the accompanying drawings.

DESCRIPTION OF THE PREFERRED EMBODIMENT

Like portions or parts are indicated by like numerals and characters throughout the specification and drawings.

Figure 4:
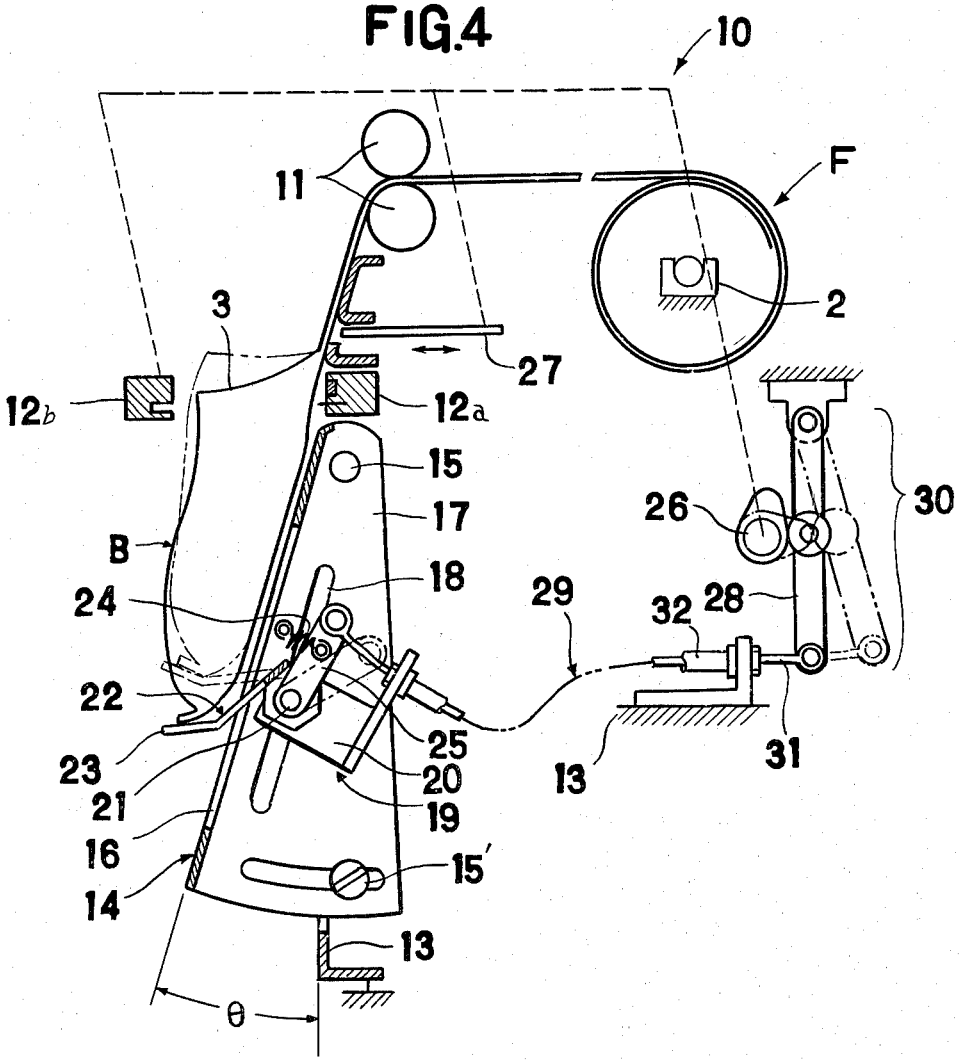
FIG. 4 is a schematic side view of one embodiment of the present invention.

Referring now to FIG. 4, there is shown a packing machine 10 which is provided with a pair of intermittently operated pinching rollers 11 extending horizontally and adapted to transfer a certain strip-like plastics bag material F for a distance at a time corresponding to the length of a single bag B. Under the pinching rollers 11 there is provided a pair of heat-sealers **12*a* and 12*b*. One of the heat-sealers 12*a* is fixedly mounted on the frame 13 of the machine 10, while the other of the heat-sealers 12*b* is displaceably mounted to move toward and away from the one heat-sealer 12*a***.

A guide plate 14 for guiding a foremost bag B of the bag material F is provided under the stationary heat-sealer **12*a* at a front portion of the machine 10. The guide plate 14 is provided with side walls 17 and is pivotally attached at its upper portion to the frame 13 of the machine 10 by a pin 15, which extends horizontally in parallel with the axes of heat-sealer 12*a* and pinching rollers 11 through the side walls 17, so that it can be swung on the pin 15 within a predetermined angular range $\theta$. The guide plate 14 can be immovably held at the desired angular position within the angular range $\theta$ by means of a clamp screw 15'**.

A plurality of vertically extending slits 16 are formed in the guide plate 14. Elongated openings 18 are formed in the side walls 17 of guide plate 14 in parallel with the plane of the guide plate. Mounting members 20 for mounting parts of a supporting device 19 for supporting the foremost bag B of the bag material F are slidably mounted on insides of the side walls 17 so that they can be displaced along the elongated openings 18. The mounting members 20 are arranged to be secured to the side walls 17 of guide plate 14 at the desired height along the elongated openings 18 by clamp means. A pivot shaft 21 which extends transversely across the side walls 17 through the elongated openings 18 in parallel with the axes of the pinching rollers 11 is rotatably supported by the mounting members 20. A comblike supporting member 22 having a pectination 23 for supporting the bag B is fixedly mounted at its base portion on the shaft 21. The pectination 23 projects outwardly of the guide plate 14 through the slits 16 formed therein. The free end portions of the pectination 23 is normally biased obliquely downwardly by means of a spring 24. A lever 25 is also fixedly mounted on the shaft 21 so that as it is moved, the supporting member 22 is rotated with the shaft 21. If the supporting member 22 and the lever 25 are integrally formed, they can be rotatably mounted on the shaft 21. In this case, the shaft 21 may be fixed to the mounting members 20.

Figure 1:
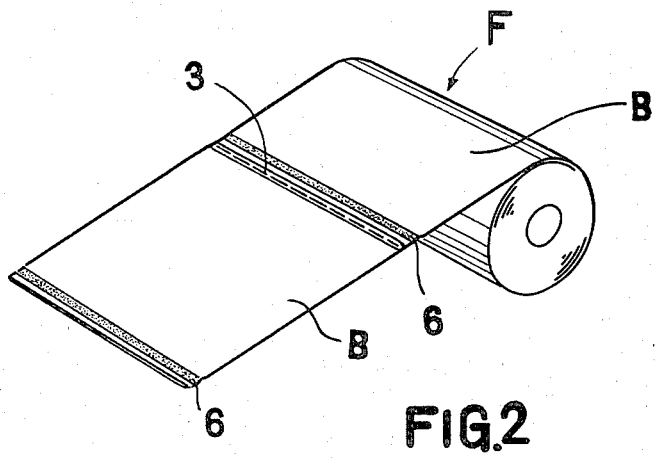
FIG. 1 is a perspective view of one form of the strip-like bag material for use in the machine of the present invention.
Figure 2:
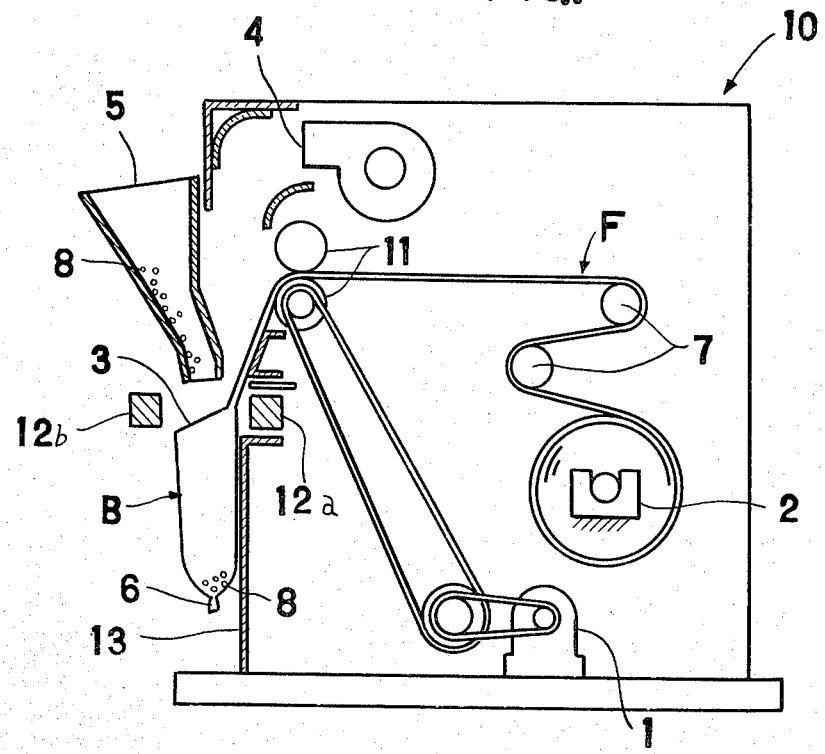
FIG. 2 is a schematic side view of a conventional packing machine.
Figure 3:
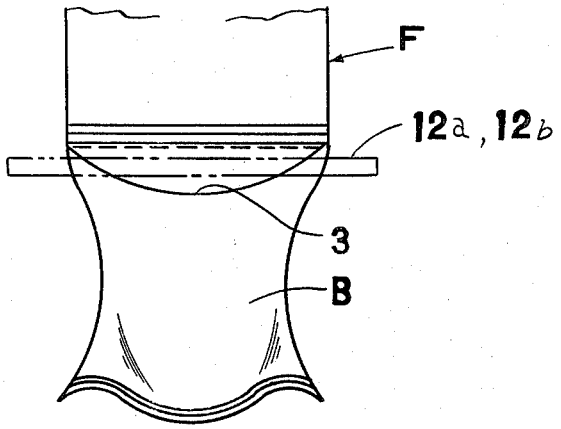
FIG. 3 is a front view of the bag section in which goods have been filled by the conventional machine, illustrating the state in which the bag has been deformed by the weight of the goods.

A shaft 26 is provided having members, such as a cam for operating a limit switch, an eccentric, etc. for sequentially operating operative parts of the machine 10 and which is in driven connection with the motor 1 (shown in FIG. 1). Of course, the movable heat-sealer **12*b* and a device 27 for cutting the bag material F as the operative parts are operated sequentially by rotation of the shaft 26**.

A reciprocating crank mechanism 30 which comprises a cam mounted on the shaft 26 and a reciprocating lever 28 actuated by the cam is operatively connected with the lever 25 on the pivot shaft 21 by means of a flexible pulling member 29. The flexible pulling member 29 comprises a wire 31 and a flexible tube 32 without elasticity, covering the wire 31 loosely. In the illustrated embodiment, the tube 32 is connected at one end to an extension of one of the mounting members 20 and at the other end to the frame 13 or to a member mounted thereon, and the wire 31 is connected at one end to the free end of the lever 25 and at the other end to the free end of the reciprocating lever 28, so that as the wire 31 is pulled by the reciprocating lever 28, the supporting member 22 is caused to rotate about the axis of the shaft 21 against the action of the spring 24 in the clockwise direction as seen in FIG. 4. The reciprocating crank mechanism 30 is operatively connected with the movable heat-sealer **12*b* such that mechanism 30 is operated immediately before the sealer 12*b* is moved toward the stationary heat-sealer 12*a***.

In cases where a strip-like bag material F to be used has relatively long bag sections B, the supporting device 19 is displaced to such a lower position along the elongated openings 18 that the pectination 23 of the supporting member 23 is brought into contact with the bottom of the foremost bag B, which depends from the position slightly above the height of the heat-sealers **12*a*, 12*b*, to support said bottom. On the other hand, if a strip-like bag material F to be used has relatively short bag sections B, the supporting device 19** is raised for the purpose mentioned above.

To pack goods into the foremost bag B of the strip-like bag material F, it is brought into the predetermined position by driving the drag rollers 11 where the opening portion 3 formed transversely across the bag material F of a collapsed plastics film tube on one side thereof is situated at a height which is slightly higher—to the order of 2–5 mm—than the height of the upper surfaces of the heat-sealers **12*a*, 12*b*. The bag B is then blown by means of the air blower 4 (FIG. 1) and then goods are filled therein through the hopper 5**.

As the wire 31 is pulled by operation of the crank mechanism 30, the supporting member 22 is caused to rotate about the axis of shaft 21 clockwise as seen in FIG. 4 against the action of the spring 24 to uphold the bottom of the bag B, in which goods have been packed, with its pectination 23 and to cause the transversely extending rectilinear opening portion 3 of the bag to be substantially aligned with the corresponding opposite portion of the other side of the bag material F. Under such condition, the movable heat-sealer **12*b* which is in driven connection with the shaft 26 is moved toward the stationary heat-sealer 12*a* to heat-seal the opposite sides of the bag B along the rectilinear opening portion 3 thereof and finally, the bag B thus heat-sealed is separated from the bag material F. As the bag is separated, the supporting member 22 is caused to be returned to its original position by operation of the crank mechanism 30 and by the action of the spring 24**.

It will be seen from the foregoing that the provision of the aforementioned supporting device 19 makes it possible to prevent deformation of the opening portion 3 of the bag B, which tends to be caused by the weight of the goods filled into the dependent bag and which causes incorrect heat-sealing of the same, regardless of the fact that the bag material F as used in the packing machine 10 had either long bag sections or short bag sections, and that the operative connection of the crank mechanism 30 with the bag-supporting member 22 of the device 19 by means of the flexible pulling member 29 will enable the device 19 to be freely displaced along the elongated openings 18 of the guide plate 14 for adjustment of the height of the device 19.

It is to be noted that in the illustrated embodiment, the guide plate 14 can be set at the desired angular position within the predetermined angular range $\theta$ in accordance with the kind or quantity of goods to be packed.

What I claim is:

1. A packing machine for filling and sealing a series of bags comprising a pair of intermittently operated pinching rollers for intermittently transferring a strip-like bag material of a collapsed plastics film strip, a stationary heat-sealer, a movable heat-sealer arranged to move toward and away from said stationary heat-sealer in a horizontal plane to seal the tops of said bags, a guide plate provided under said stationary heat-sealer at a front portion of the machine for guiding a leading bag section formed in said bag material and having a transversely extending opening portion thereof, said guide plate having along a front face a plurality of vertically extending parallel slits, a supporting device for supporting the leading bag section, said supporting device being provided on a rear side of said guide plate and arranged to be capable of being raised and lowered therealong and comprising a comblike supporting member having a pectination projecting frontwardly of said guide plate through said slits thereof and arranged to be swung about a horizontal axis so as to be capable of upholding a bottom of the leading bag section with said pectination when said supporting member is swung upwardly, said pectination being normally biased obliquely downwardly by means of a spring, a reciprocating crank mechanism operatively connected to said movable heat-sealer for sequentially operating operative parts of the machine and said movable heat-sealer, said reciprocating crank mechanism being drivingly connected to said supporting member by means of a flexible pulling member so that said supporting member can be swung upwardly about said horizontal axis against the action of said spring as said flexible pulling member is pulled by said crank mechanism, means for operatively connecting said reciprocating crank mechanism and said movable heat-sealer such that said crank mechanism pulls said flexible pulling member to cause said supporting member to be upwardly swung immediately before said movable heat-sealer is moved toward said stationary heat-sealer and after the filling operation to raise at least a portion of said top of said bag relative to said heat sealers to a proper sealing position.

2. A packing machine as set forth in claim 1, wherein said guide plate is provided with side walls and is pivotally attached at an upper portion thereof to a frame of the machine by a pin which extends horizontally in parallel with axes of said stationary heat-sealer and said pinching rollers so that said guide plate can be swung on said pin within a predetermined angular range.

3. A packing machine as set forth in claim 2, wherein said supporting device is vertically slidably mounted on said side walls of said guide plate.

* * * * *